US007563171B2

(12) United States Patent
Barz

(10) Patent No.: US 7,563,171 B2
(45) Date of Patent: Jul. 21, 2009

(54) PUTTING RANGE ASSEMBLY

(76) Inventor: William Barz, 1008 Highland Dr., St. Clair, MI (US) 48079

( * ) Notice: Subject to any disclaimer, the term of this patent is extended or adjusted under 35 U.S.C. 154(b) by 0 days.

(21) Appl. No.: 11/543,534

(22) Filed: Oct. 5, 2006

(65) Prior Publication Data

US 2007/0078023 A1 Apr. 5, 2007

Related U.S. Application Data

(60) Provisional application No. 60/723,754, filed on Oct. 5, 2005.

(51) Int. Cl.
*A63B 69/36* (2006.01)

(52) U.S. Cl. ..... 473/185; 473/163; 473/196

(58) Field of Classification Search ..... 473/157–164, 473/170, 180, 181, 182, 184, 185, 190–192, 473/194–196; 273/352
See application file for complete search history.

(56) References Cited

U.S. PATENT DOCUMENTS

| | | | | | |
|---|---|---|---|---|---|
| 1,185,071 | A | * | 5/1916 | DoeBrich | 273/352 |
| 1,377,869 | A | * | 5/1921 | Blackburn | 235/1 B |
| 1,637,407 | A | * | 8/1927 | Brumder | 473/184 |
| 1,689,475 | A | * | 10/1928 | Brumder | 473/184 |
| 2,232,569 | A | * | 2/1941 | Johnson | 473/191 |
| 2,704,212 | A | * | 3/1955 | Dunseith | 473/185 |
| 2,987,319 | A | * | 6/1961 | MacKenzie | 473/185 |
| 3,526,405 | A | * | 9/1970 | Morris | 473/191 |
| 3,826,501 | A | | 7/1974 | Hiromachi | |
| 3,843,136 | A | | 10/1974 | Buenzle | |
| 4,336,939 | A | * | 6/1982 | Krumlauf | 473/183 |
| 4,572,512 | A | | 2/1986 | Tegart | |
| 4,696,474 | A | | 9/1987 | Tegart | |
| 4,828,267 | A | * | 5/1989 | Goodrich | 473/160 |
| 5,033,745 | A | * | 7/1991 | Sullivan et al. | 473/184 |
| 5,042,813 | A | | 8/1991 | Huang | |
| 5,100,145 | A | | 3/1992 | Kim | |
| 5,102,141 | A | | 4/1992 | Jordan | |
| 5,171,016 | A | | 12/1992 | Kamal | |
| 5,366,224 | A | | 11/1994 | Stanwyck et al. | |
| 5,586,941 | A | * | 12/1996 | Klearman | 473/160 |
| 5,863,256 | A | | 1/1999 | MacLean et al. | |
| 6,428,420 | B1 | | 8/2002 | Durnell | |
| 6,672,971 | B2 | | 1/2004 | Barlow | |
| 7,294,062 | B2 | * | 11/2007 | Ting | 473/162 |
| 2003/0236127 | A1 | | 12/2003 | Richter et al. | |

* cited by examiner

*Primary Examiner*—Mark S Graham
(74) *Attorney, Agent, or Firm*—Howard & Howard Attorneys PLLC

(57) ABSTRACT

A portable training device is used for improving putting skills of a player by putting a ball. A plurality of sections are removably connected with one another to define an upper section and a lower section presenting an inclined axis. At least one compartment is defined in each of the sections for receiving the ball. A channel defined in at least one of the sections extends parallel the inclined axis and communicates with the at least one compartment to receiving the ball and returning the ball trough at least one of the channels.

8 Claims, 8 Drawing Sheets

PUTTING RANGE ASSEMBLY

RELATED APPLICATIONS

This application claims priority to U.S. Provisional Patent Application Ser. No. 60/723,754 filed Oct. 5, 2005.

FIELD OF THE INVENTION

The present invention relates generally to a game of golf, and more particularly to a portable putting device suitable for indoor and outdoor use.

BACKGROUND OF THE INVENTION

A large market exists for practice aids to improve the golfing skills of recreational and competitive golfers. A focal point of this market is devices used to improve putting skills. Various types of devices are available to improve putting accuracy.

One type of device that has been developed is the simulated putting green used for practice in a basement, recreation room, back yard, etc. However, the natural lie of the terrain of a golf course leads to a practically infinite number of different situations which may be encountered by a golfer, and most such artificial devices do little to simulate some of the irregularities which can occur on a green, such as different slopes. While some earlier devices have seen the need to provide different slopes to simulate such conditions, such devices are generally cumbersome to set up, have limited or no adjustability, and/or have some other deficiency which makes their utility less than ideal.

Various other golf training devices and methods have been taught by the U.S. Pat. No. 5,102,141 to Jordan; U.S. Pat. No. 5,863,256 to MacLean et al.; U.S. Pat. No. 5,915,854 to Burke et al.; U.S. Pat. No. 5,796,640 to Sugarnan et al.; and the United States Application No. 2003/0236127 to Richter et al. The United States Application No. 2003/0236127 to Richter et al., for example, teaches a portable putting trainer suitable for indoor or outdoor use to provide feedback to the user concerning the speed of the putt and the direction of the ball. A ramp of the trainer presents an elevation angle ranging between 3 degrees and 30 degrees for the portion of maximum slope of the ramp. The slope of the ramp is made shallow enough such to cause only minor disruption to the smooth rolling of a putted ball. However, if the ramp is too steep, i.e., having the elevation angle of more that 30 degrees, the ball may strike the ramp and bounce up unpredictably, thereby disrupting the subsequent measurement and categorization of its final distance of roll beyond a hole defined by the trainer. If the ramp is too shallow in slope, on the other hand, it will require greater distance along the intended line of the ball in order to achieve the elevation necessary for the substantially horizontal upper surface of the trainer and subsequent distance categorization structures.

Unfortunately, none of these devices satisfactorily contemplate the development of "touch," i.e., the ability to control speed in correlation with actual distance on a typical putting green. Therefore, it would be desirable to provide an improved and effective practice device for practicing proper speed and direction of putting a golf ball that accurately correlates to the distance of a typical putting green.

SUMMARY OF THE INVENTION

A portable training device (the device) is used for improving putting skills of a player by putting a golf ball (the ball).

The portable training device is positioned on a horizontal surface. A plurality of sections of the device, are removably connecting and present an upper section and a lower section forming an inclined axis. Each section is formed from a first portion and a second portion. Each section is injection molded from a polymeric material. The first portion has a plurality of compartments oriented substantially perpendicular to the inclined axis and communicates with the respective compartments defined in the second portion for receiving the ball. A plurality of shock absorbing fins are removably disposed in the first portion between the compartments for directing the ball into the compartments. The compartments are sufficiently narrow to ensure accurate putting direction. If the putt is not directed accurately, the golf ball will fall into one of upper opposing gutters disposed upon opposite sides of the compartments and the golf ball is then returned to the player. A channel is defined in each of the first and second portions extending parallel the inclined axis and substantially perpendicular to the compartments receiving the ball and directing the return of the ball along the inclined axis.

A ramp is removably connected to the lower section. Similar to the aforementioned sections, the ramp is injection molded from the polymeric material. The ramp has an arcuate surface that extends between a distal edge of the ramp for receiving the ball and a front edge of the ramp for launching the ball relative to the inclined axis under a launching angle, defined between the front edge and the horizontal surface in response to the external impact received by the ball from the player. This inventive ramp employs the physics of projectile motion wherein the ball struck with sufficient energy for a long putt is confined to a significantly shorter distance accurately correlated to a longer distance on a typical putting green. The aforementioned compartments are configured to develop a touch incrementally over a long distance as the ball is rolled up the arcuate surface of the ramp and launched in an upward trajectory. Upon decent, the ball engages shock-absorbing fins and is guided into one of the compartments of the first portion. The ball may be retained in the compartment by a golf tee or retaining peg inserted into the second portion of each section. In the absence of the peg, the ball returns to the player along the channel. A net surrounds the device for capturing the balls if necessary. The net is supported by a pole framework secured to the device.

An advantage of the present invention is to provide an effective practice device for developing proper speed and direction in putting a ball.

Another advantage of the present invention is to provide a training device that helps the player to comprehend the development of "touch," or the ability to control the speed of the ball in a short distance in correlation with long distances on a typical putting green.

Still another advantage of the present invention is to provide a portable putting trainer suitable for indoor use that is correlated to outdoor putting greens.

Still another advantage of the present invention is to provide a portable putting device that is small in size and presents a lightweight construction to enable the player to comfortably transport the device between various locations.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
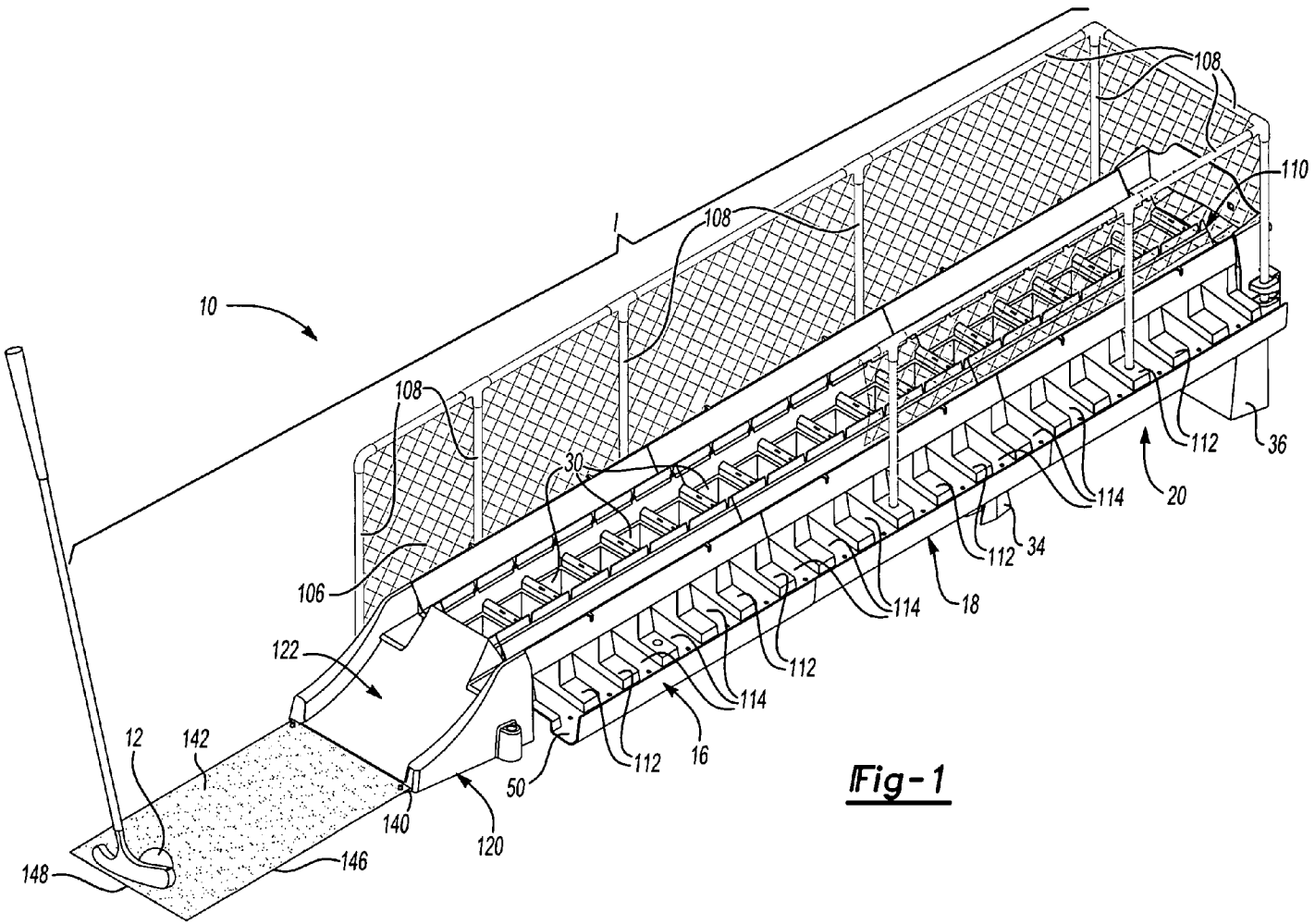
FIG. 1 illustrates a perspective view of a putting device of the present invention having a ramp and a plurality of interconnected sections defining multiple compartments for receiving a golf ball.
Figure 2:
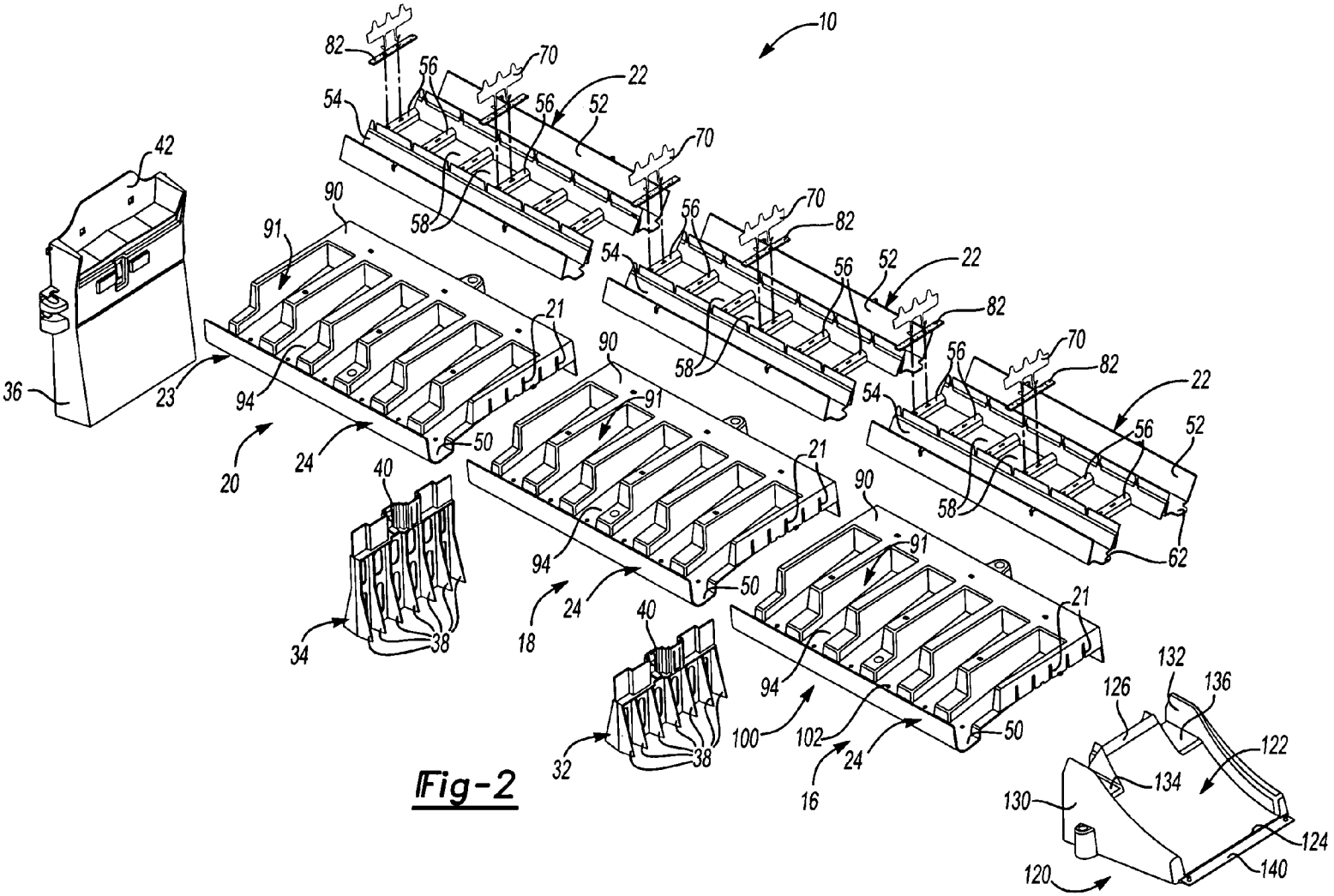
FIG. 2 illustrates a perspective exploded view of the putting device of FIG. 1.

Referring now to FIG. 1, wherein like numerals indicate like or corresponding parts and a portable training device (the device) of the present invention is generally shown at 10. The device 10 is used for improving putting skills of a player (not shown) by putting a golf ball (the ball) 12. The device 10 is positioned on a horizontal surface 14 such as, for example, an indoor floor or small area. The device 10 includes three sections, generally shown at 16, 18, and 20 (see FIG. 2), removably connected to one another. Those skilled in the art will appreciate that more or less than three sections 16, 18 and 20 may be used to practice the present inventive device 10 without limiting the scope of the present invention. The sections 16, 18, and 20 are preferably formed from a polymeric material in an injection mold (not shown). Other methods, such as thermoforming, and the like may be utilized to form the sections 16, 18, 20. The sections 16, 18, 20 are generally identical to one another, as illustrated in FIGS. 1 and 2. When assembled, the sections 16, 18, and 20 define an inclined axis I, the purpose of which will be explained further below. The sections 16, 18, and 20 are supported and securely connected together by connecting tabs (not shown). Alternatively, the sections 16, 18, 20 may present various other configuration, based on various application requirements and without limiting the scope of the present invention.

As best illustrated in FIG. 2, each section 16, 18, and 20 is formed from an upper portion, generally indicated at 22, and a lower portion, generally indicated at 24. As assembled, the upper and lower portions 22, 24 form a multitude of compartments 30 for capturing the ball 12 advanced by the player. Each of the compartments 30 are oriented substantially perpendicular to the inclined axis I. The upper portion 22 and the lower portion 24 of each section 16, 18, and 20 mechanically connect through a plurality of integrally molded male and female mechanical connectors. Alternatively, as best seen in FIG. 2, support posts 32 and 34 are disposed between the sections 16 and 18, and in a manner that interlocks sections 18 and 20, respectively, in an interlocking manner securing sections 16, 18 and 20 together in a common plane. Support posts 32, 34, and 36 have respectively increasing lengths thereby inclining the sections 16, 18, and 20 to define the inclined axis I. The support posts 32 and 34, i.e., a rear support post (32) and a middle support post (34), have substantially identical configuration defining a plurality of trapezoidal plates 38 integrally connected supporting a mechanical connector, generally indicated at 40. The mechanical connector 40 engages a plurality of respective interlocking tabs (not shown) or aligned slots 21 at the mating surfaces of sections 16, 18, and 20 for securing together adjacent sections 16 and 18, and 18 and 20. The support post 36 presents a configuration that differs from the configuration of the support posts 32 and 34 and taller than support post 32 which is taller than support post 34. The support post 36 defines a receptor 42 configured to receive a distal end 23 in section 20. The symmetric design of the interlocking tab 40 and slot 21 of each of the sections 16, 18, 20 allow a lower channel or return gutter 50 (to be discussed further below) of each of the lower portions 24 to be positioned on either the left or right side of the sections 16, 18, and 20 depending on the user's preference.

The upper portion 22 of each section 16, 18, 20 are further defined by opposing spaced upper channels 52 and 54 oriented parallel to axis I. A plurality of spacers 56 interconnect the spaced upper channels 52 and 54 thereby forming a plurality of spaced openings 58 disposed between channels 52 and 54 for receiving the ball 12. Each of the spaced side channels 52 and 54 define a cavity 60 (FIG. 9) at one end and a boss 62 extending from the opposite end to align the mechanical connection of the upper portions 22 of each section 16, 18, and 20 during assembly of the device 10.

Figure 4:
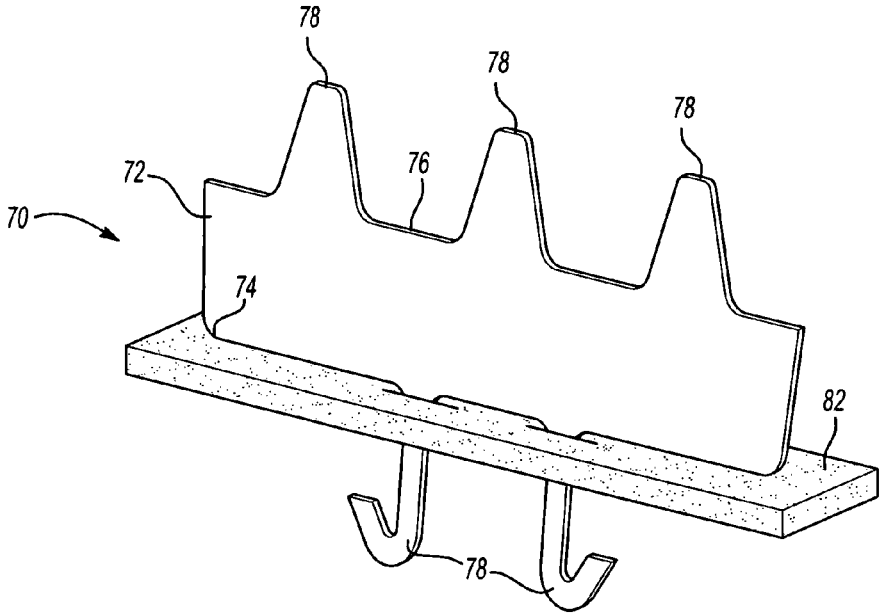
FIGS. 4 through 8 show various embodiments of the shock absorbing fins.
Figure 5:
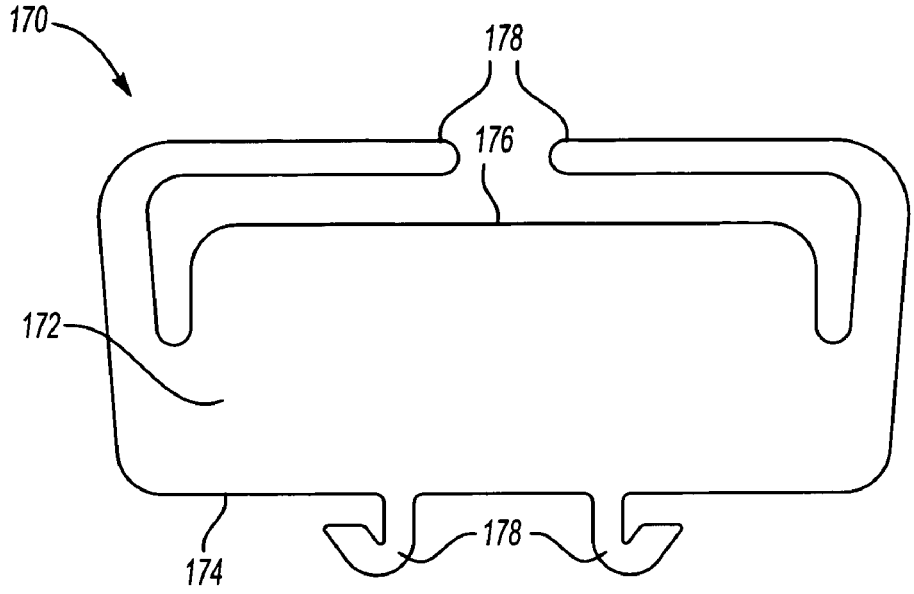
Figure 6:
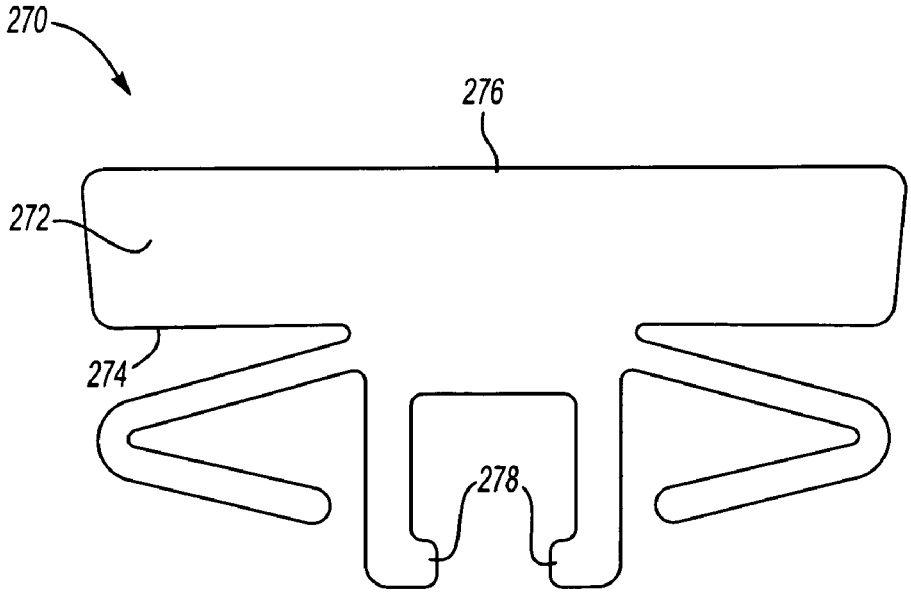
Figure 7:
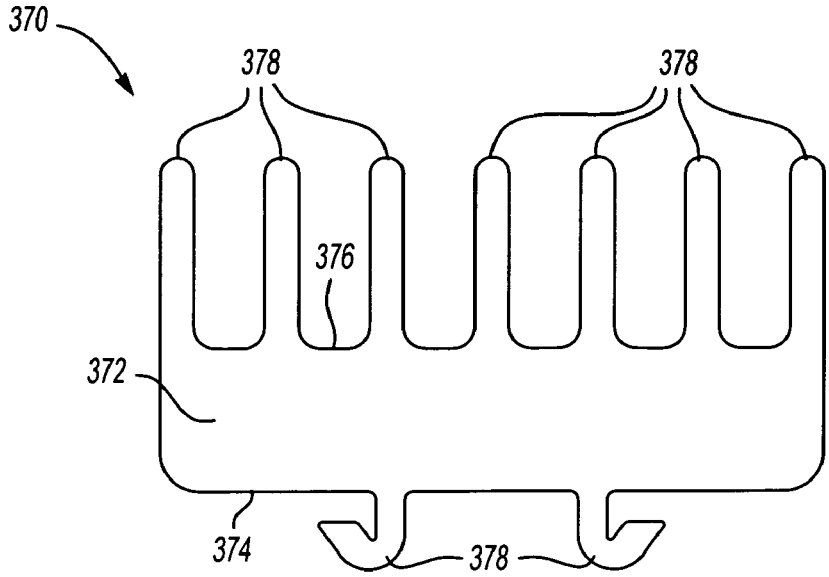
Figure 8:
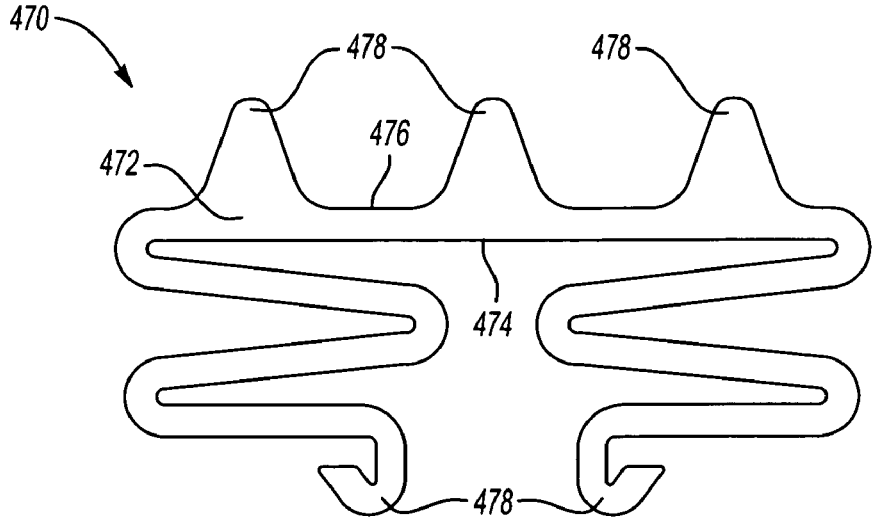

As best illustrated in FIG. 2 and also in FIGS. 5 through 8, a fin 70 is slidably received by a notch disposed in each spacer 56. Each fin 70 is designed for absorbing the impact of the ball 12 as the ball contacts the fin 70 to direct the ball 12 into the compartment 30 defined between each spacer 56. Alternative fins 70 are shown at 170 in FIG. 5, 270 in FIG. 6, 370 in FIG. 7, and 470 in FIG. 8. Each of the fins 70, 170, 270, 370, and 470 includes a body 72, 172, 272, 372, and 472 having a first edge 74, 174, 274, 374, and 474 and a second edge 76, 176, 276, 376, and 476 and a mechanical connector 78, 178, 278, 378, and 478 extending outwardly from the first edge 74, 174, 274, 374, and 474. The mechanical connector 78, 178, 278, 378, and 478 is received by a notch 55 defined in each spacer 56 in a manner that allows each fin 70, 170, 270, 370, and 470 to pitch relative the spacer 56. Each fin 70, 170, 370 and 470 presents a shock absorbing member 78, 178, 378, 478 extending outwardly from the second edge 76, 176, 376, and 476. If a putt is online, the golf ball 12 enters either the compartment directly or is guided into the compartment by the shock-absorbing fins 70, 170, 270, 370, and 470. The angle of the fins 70, 170, 270, 370, and 470 is preferably designed to be parallel to the entry angle of the launched ball 12. The determination of this angle will be described as the description of the present invention proceeds. The fins 70, 170, 270, 370, and 470 are flexible to prevent the incoming ball 12 from bouncing or being redirected to another compartment 30. A foam member 82 is alternatively connected to the fin 70 as shown in FIG. 4 to provide additional shock absorbing properties. Preferably, the foam provides visco-elastic properties and is produced from urethane polymer. However, other foam materials may be used as is known to those of skill in the art.

Referring again to FIG. 2, each of the lower portions 24 includes upper surface 90 that mates with the under side of the cooperating upper portion 22. The lower portion 24 includes spacing walls 91 separated by an inclined floor 94 for directing the ball 12 into the return gutter 50. The ball 12 is optionally held in the compartment 30 by inserting a retaining peg or golf tee 100 into holes 102 defined in the inclined floor 94.

A net 106 best seen in FIG. 1 is supported by a frame 108 forming a backstop for guiding the golf ball 12 into gutter 110 or channel 54. An egresses 114 is aligned with each of the spaced openings 58 of the upper portion 22 for receiving the ball 12 and for transferring the ball 12 through the return gutters 50 of each section 16, 18, and 20 and ultimately to the player along the inclined axis I.

Figure 3:
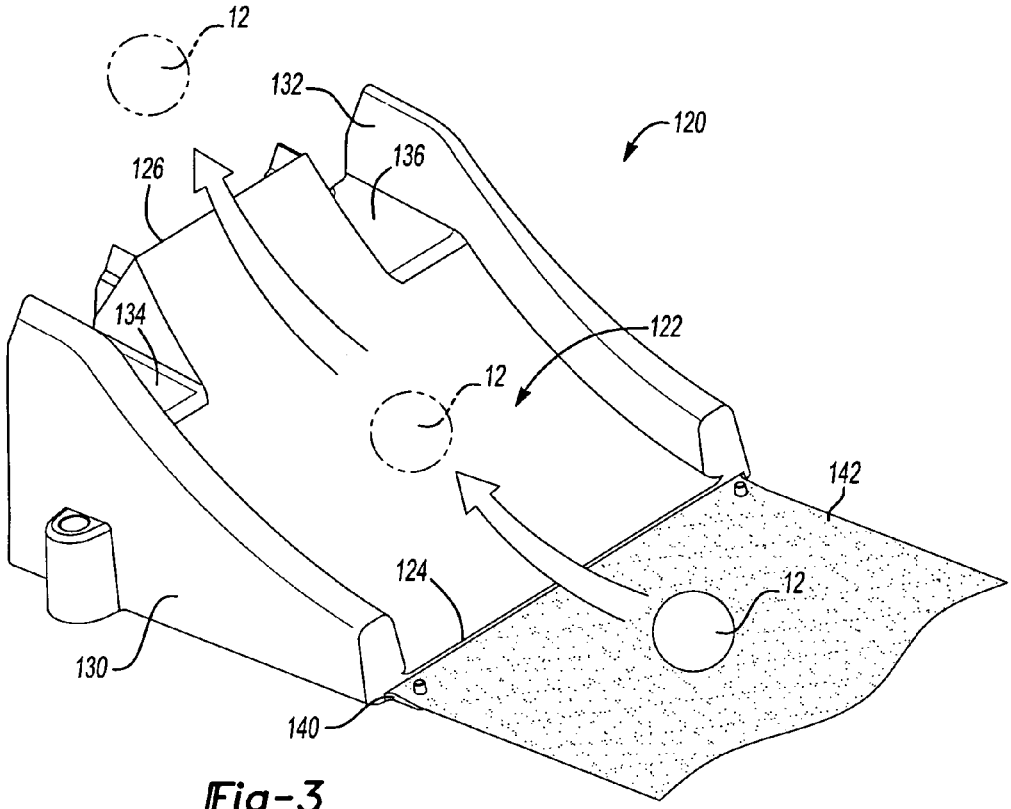
FIG. 3 shows a perspective view of the ramp of the putting device.
Figure 9:
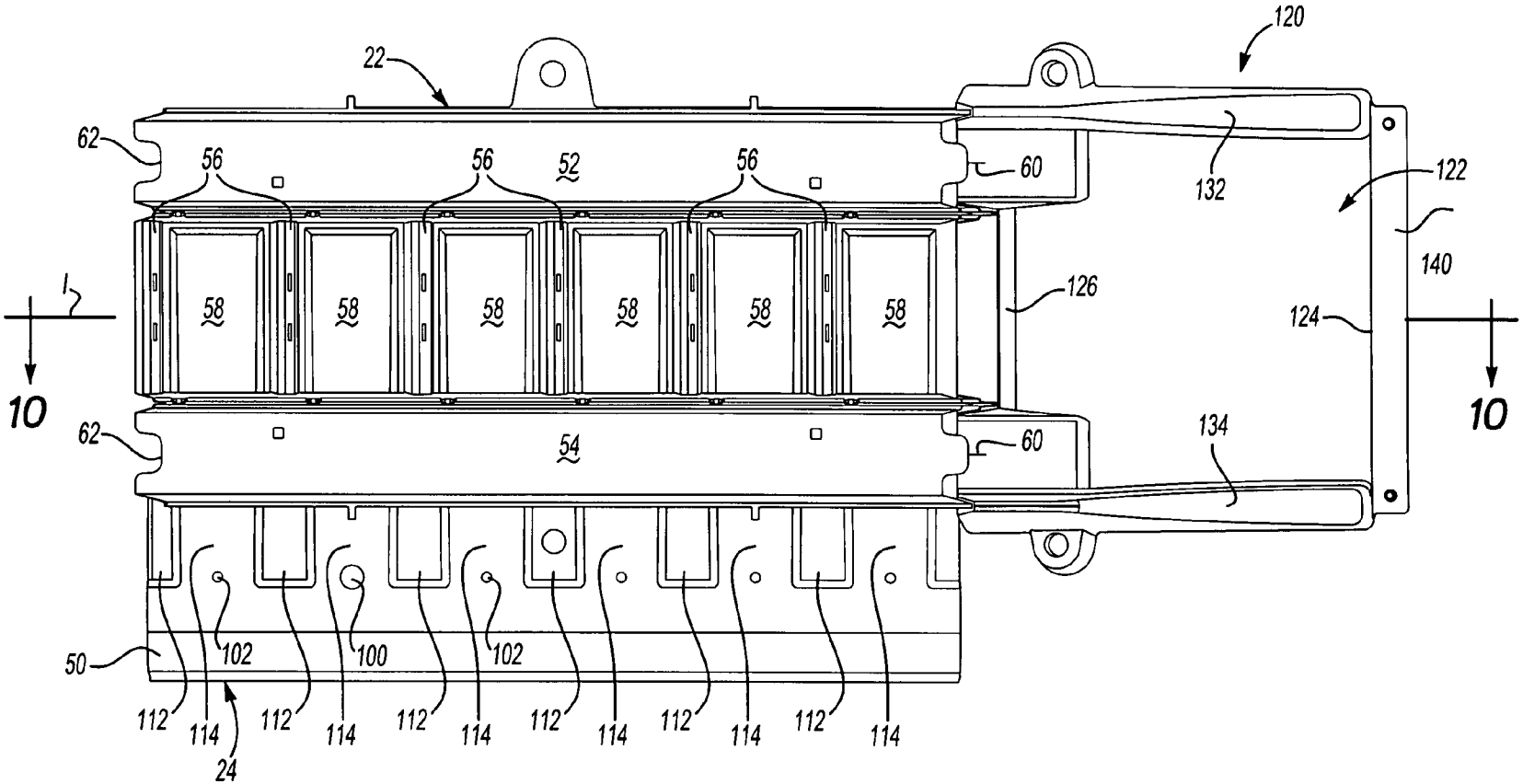
FIG. 9 illustrates a top view of one of the sections connected to the ramp.
Figure 10:
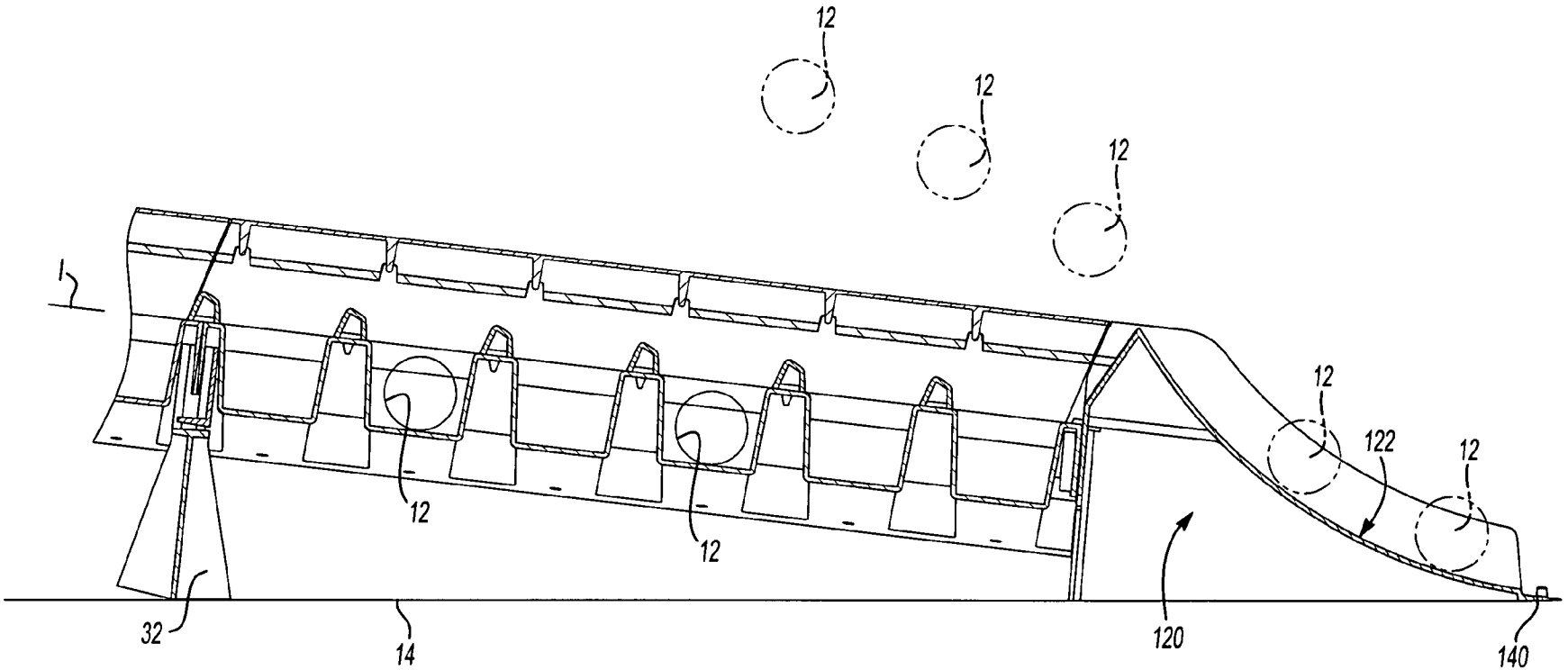
FIG. 10 illustrates a cross sectional view of FIG. 9 showing various trajectories of a ball launched as a result of an external impact along the ramp from a substantially horizontal plane of a mat to a launch angle defined by the ramp along line 10-10 of FIG. 9.

As best shown in FIGS. 2, 3 and 9, a ramp, generally shown at 120, removably connects to the section 16. The ramp 120 presents an arcuate surface, generally indicated at 122, extending between a distal edge 124 of the ramp 120 for receiving the ball 12 and a front edge 126 for launching the ball 12 upwardly along inclined axis I at a launch angle A (FIG. 11) in response to the impact upon the ball 12 from a putter. The launch angle inclines generally is less than about 58 degrees, the advantages of which will be described further below. Alternatively, the launching angle ranges between about 58 degrees and 89.9 degrees. The acute surface 122 of the ramp 120 is configured in such a way that it gradually directs the ball 12 from the horizontal plane 14 to the launch angle A.

Alluding to the above, the ramp 120 further includes opposing side walls 130 and 132 extending along the concave surface 122 and a pair of spaced flat portions 134 and 136 extending generally parallel to the horizontal surface 14 on opposite sides of the front edge 126 of the ramp. The spaced flat portions 134 and 136 are aligned to the spaced upper channels 52 and 54 of the upper portion 22 of the section 16, as best shown in FIGS. 1 and 9. Therefore, the ball 12 falling into the spaced upper channels 52 and 54 returns to the player through at least one of the spaced flat portion 134 and 136. A lip portion 140 extends along the distal edge 124 of the ramp 120 to receive a practice mat 142, i.e., "green," as best shown in FIG. 3.

The inventive ramp 120 employs the physics of projectile motion transferring horizontal directed energy to vertically directed energy to the ball 12. As explained below, this simulates a long putt in a significantly shorter distance. The aforementioned compartments 30 are configured to correlate with long distances on a putting green so that even a forty foot putt is simulated in just a few feet when the horizontally directed energy is transferred to vertically directed energy by the inventive ramp 120. This allows the golfer to repeatedly practice, for example, forty foot putts in a very short distance.

The practice mat 142 is sufficiently long enough to allow for a full putting stroke and provides a smooth transition to the ramp 120. The texture of the practice mat 142 provides some deceleration of the ball 12 simulating a putting green. Different textures and materials of the mat 142 can be selected to provide a specific deceleration rate. Typically, an extrusion process manufactures the plastic or rubber mat with the holes and load feature being die-cut.

Figure 11:
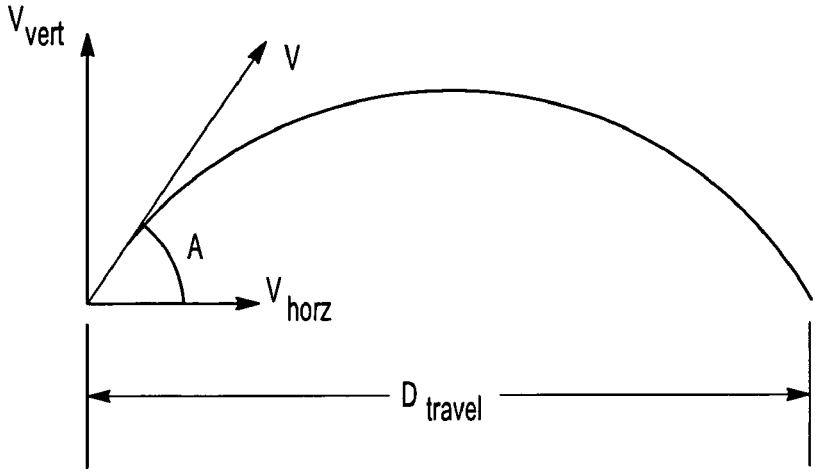
FIG. 11 illustrates a trigonometric graph of a projectile motion of the ball launch from the ramp under the launch angle.
Figure 12:
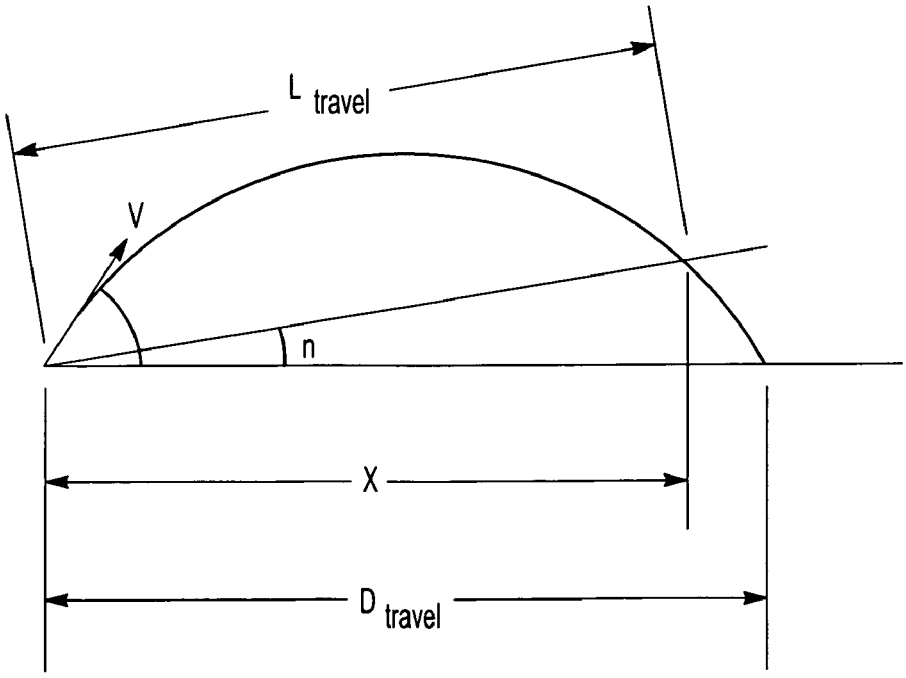
FIG. 12 illustrates a trigonometric graph of a ball return motion.

Referring to FIGS. 11 and 12 in support of the explanation of the unique configuration of the ramp 120, according to laws of physics, an object in motion will continue its motion unless acted upon by some external force. In the case of the ball 12, the ball 12 will continue to roll indefinitely unless acted upon by the deceleration properties of the putting surface, i.e., the ramp 120. Naturally the deceleration properties of golf greens vary due to slope, grass texture, cut grain, and many other factors. A Stimpmeter is a device that takes these factors into account. Basically, the Stimpmeter is a 30 inch ramp, which launches a golf ball down a twenty degree incline. The distance the ball rolls beyond the end of the ramp across a putting surface is the Stimpmeter rating. An excerpt from an article by the United States Golf Association regarding Stimpmeter ratings: "Speed charts have been developed, based on data from tests performed by the USGA Green Section agronomists over the years. The charts are presented for general information only; it is NOT the intention of the USGA to attempt to standardize green speeds, which should remain up to the course officials, with the input of the superintendent, of each facility.

Speeds of Regular Membership Play[1]
Fast>8'6"
Medium=7'6"-8'6"
Slow<7'6"
Speeds for Tournament Play[2]
Fast>9'6"
Medium=8'6"-9'6"
Slow<8'6"

[1]Bermudagrass putting greens typically are slower.

[2]These speeds can be used as a guide for club events. National competitions may require higher speeds."

In fact, Stimpmeter readings between 12'-13' have been measured on greens of the Augusta National Golf Course during the Masters Tournament. The Stimpmeter reading is inversely proportional the average deceleration of a green. This is shown with the following formulas:

Energy=Potential (ball on ramp)=Work (stop rolling ball)

$$E=m*g*h=m*a*d$$

$$g*h=a*d$$

$$32.2\ \text{ft/s}^2*\sin 20°*30''/12''/\text{ft}=a*d$$

Therefore if the distance the ball rolls on the putting surface (d (Stimpmeter rating)) goes up, the green deceleration (a) must decrease Physics tells us that the average deceleration of a green having a Stimpmeter reading of 9'6", for example, is roughly 2.9 ft/s$^2$. This value will be used in subsequent calculations. Alluding to the above, the theory of projectile motion states that for an object launched at an angle A at a velocity V, an object will travel $D_{travel}$. The following equations and calculations demonstrate the principle.

$$V_{vert}=V*\sin A\ V_{horz}=V*\cos A$$

Time for object to reach peak:

$$t_{peak}=V_{vert}/g$$

So total travel time:

$$t_{travel}=2*t_{peak}$$

The distance the object travels follows:

$$D_{travel}=V_{horz}*t_{travel}$$

Substitution of the above formulas yield:

$$D_{travel}=V*\cos A*2*V*\sin A/g$$

$$D_{travel}=V^2*2*\cos A*\sin A/g$$

$$V^2=D_{travel}*g/(2*\cos A*\sin A)$$

As such, Energy=Kinetic (ball in motion)=Work (stop rolling ball)

$$E=m*v^2/2=m*a*d$$

$$v^2=2*a*d$$

So, the energy it takes to roll a ball a distance of d on a putting surface with a deceleration of a, corresponds to the energy it takes to propel a ball launched at an angle A the distance $D_{travel}$ as shown below:

$$2*a*d=D_{travel}*g/(2*\cos A*\sin A)$$

For example, the energy it takes to putt a ball 20 feet on a green with a Stimpmeter rating of 9'6" (2.9 ft/s$^2$) would propel a ball 3.238 feet launched at a 58° angle. As long as the launch angle remains the same, the distance a putt ball travels on a specific green will always be proportional to the distance the ball is propelled. In this case, the energy it takes to putt a ball 10 feet will propel a ball 1.619 feet. This is the underlying concept behind this invention. Putts that would normally take a long distance can be practiced in substantially shorter confines using the inventive ramp 20 that is correlated to a typical putting green using the methodology set forth above.

Referring now to the ball return provisions, the inclusion of the ball return ramp feature requires modification to the projectile motion calculations above. The parabolic projectile path is intercepted by a plane parallel to the ball return plane through the launch point (entry plane) prior to the ball returning to the height of the launch point. The following calculations show that a scale factor is applied to the horizontal $D_{travel}$ to determine the distance traveled along the intercepting plane ($L_{travel}$).

$$x=v*\cos A*t \text{ or } t=x/v*\cos A \quad y=v*\sin A*t-(g*t^2)/2$$

$$y=v*\sin A*x/(v*\cos A)-g*x^2/(2*v^2*\cos^2 A)$$

$$y*2*v^2*\cos^2 A=x*(2*v^2*\cos A*\sin A)/g-x^2$$

$$\text{Recall } D_{travel}=v^2*2*\cos A*\sin A/g$$

$$\text{So } y*D_{travel}*\cos A/\sin A=D_{travel}*x-x^2$$

$$y=\tan A*x-\tan A*x^2/D_{travel}$$

Setting the parabolic equation for projectile motion above equal to the linear equation for the return angle yields the intercept point $$y=\tan A*x-\tan A*x^2/D_{travel}=\tan n*x$$

$$x/D_{travel}=(\tan A-\tan n)/\tan A$$

$$x=\cos n*L_{travel}$$

$$L_{travel}/D_{travel}=(\tan A-\tan n)/(\tan A*\cos n)$$

Thus the ratio of travel along a sloped plane versus a horizontal plane is constant for all distances and is dependent on the launch and return angles only. So for the previous example, the energy it takes to putt a ball 20 feet on a green with a Stimpmeter rating of 9'6" (2.9 ft/s$^2$) would propel a ball 3.027 feet along a plane 6.5° launched at a 58° angle. This invention uses a ramp to convert the horizontal energy of a putted ball to the projectile energy described above. Naturally, enough energy is required for the ball to climb the height of the ramp. The following equation demonstrates this point Energy=Kinetic(putt ball)=Work(climb ramp)+Kinetic (launched ball)

$$E=m*v_{init}^2/2=m*g*h+m*v_{final}^2/2$$

$$v_{init}^2=2*g*h+v_{final}^2$$

In the present invention, the maximum travel range is divided into equally spaced compartments 30. The length of the compartment 30 corresponds to a range the ball 12 would travel on a putting surface. For example, using the previous calculations it can be shown that a compartment length of 3.027 inches corresponds to an incremental range of 20 inches on a putting surface with a 2.9 ft/s$^2$ deceleration rate launched at 58° with a 6.5° return angle. In one embodiment, the height of the ramp is correlated to correspond to a distance traveled on a putting surface that is an exact multiple of the range determined by the compartment length. This provides the ability to calibrate results obtained by using this device to actual putting ranges. The following equations illustrate the point.

$$3*a*d=g*h \quad v^2=2*a*d$$

$$v_{init}^2=2*g*h+v_{final}^2$$

$$13*a*d=g*h+10*a*d$$

$$13*a*d=3*a*d+10*a*d$$

For example, the value of the multiple chosen should be based on engineering and manufacturing feasibility. So if a multiple of three is chosen for the example of a compartment length corresponding to a 20 inch incremental range on a putting surface which decelerates at 2.9 ft/s$^2$, the height of the ramp should be 5.4 inches. The same consideration should be given to the length and deceleration rate of the mat 142 as well.

The invention may also be utilized to practice various types of games. One of such games is "PIG," which is similar to the game associated with basketball. A first player identifies a target compartment by placing the retaining peg 100 in that compartment's hole in the inclined floor 94. That player then putts the ball 12. If the ball 12 misses the intended compartment, the next player repeats the process. If the ball 12 is made and retained in the compartment, the next player then shoots for that compartment. Players continue to shoot for that compartment until it is missed. The player who misses gets a letter and then the process starts over. Once a player receives enough letters to spell the word (i.e., 3 misses=P-I-G), that player is out of the game. The game continues until only one player remains.

Another game is "Up the Ladder." This game includes retaining pegs which are placed into the holes of each compartment. The first player begins by shooting for the first compartment. If the ball is made, the retaining peg is removed returning the ball to the putter. That player then shoots for the next compartment. This process continues until the target compartment is missed. The player's score is the number of successive compartments made. The next players repeat the process. The winner is the player with the highest score. This game can also be played by starting with the furthest compartment and moving closer.

Still another game is known as "Golf." This game is played with an embodiment of this invention including 18 compartments. Begin with a scorecard from any 18-hole golf course that ranks holes for handicapping. Place a retaining peg in the compartment corresponding to the handicap value for the first hole. For example: if the first hole is the number 5-handicap hole, place a retaining peg in the hole of the fifth compartment. The first player then takes as many shots as necessary to get a ball into that compartment. Other players follow in order with all scores being marked on the scorecard. The subsequent holes are played and the winner is determined similar to the game of golf.

Still another game is known as "Speed Golf." This game is played similar to the game listed above; however, only one shot is taken per player per hole. Retaining pegs should be placed in the target compartment and those adjacent to it. If the player hits the target compartment, he scores a birdie (1 under par). If he gets the first compartment past the target compartment, he scores a par. If he hits the first compartment in front of the target compartment, he scores a bogey (1 over par). All other compartments as well as the gutters score as a double bogey (2 over par).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A practice assembly for practicing putting a golf ball, comprising:

a ramp having a predetermined ramp angle for receiving a golf ball projected along a horizontal surface thereby translating horizontal energy of the golf ball into vertical energy;

a member receiving said golf ball from said ramp and having a plurality of receptors sequentially spaced from said ramp each sequential receptor being correlated with sequentially greater distances on a putting green thereby simulating putting distances whereby the distance disposed between a given receptor and said ramp is shorter than a correlated distance on a putting green and said predetermined ramp angle is calculated to reduce the distance of a given receptor to a correlated distance on a putting green in a repeatable manner thereby simulating actual distances on a putting green with said receptors sequentially spaced from said ramp;

said member comprises a plurality of sections interconnected to define an inclined axis; each of said sections comprising an upper portion and a lower portion having a lower return channel; and said upper portion and said lower portion are interchangeable thereby alternating said lower channel for returning the golf ball to said ramp.

2. An assembly set forth in claim 1, wherein said receptors are sequentially separated by spacers.

3. An assembly as set forth in claim 2, wherein said spacers each include a guide fin for guiding the golf ball into said receptors.

4. An assembly as set forth in claim 1, wherein said ramp defines an arcuate surface.

5. An assembly as set forth in claim 1, wherein said member defines opposing upper channels for receiving a golf ball thereby returning the golf ball to said ramp.

6. An assembly as set forth in claim 2, wherein said member is supported by support posts having increasing lengths thereby defining an inclined axis.

7. An assembly set forth in claim 1, further including a retaining net for retaining the golf ball on said member.

8. A practice assembly for practicing putting a golf ball, comprising:

a ramp having a predetermined ramp angle for receiving a golf ball projected along a horizontal surface thereby translating horizontal energy of the golf ball into vertical energy;

a member receiving said golf ball from said ramp and having a plurality of receptors sequentially spaced from said ramp each sequential receptor being correlated with sequentially greater distances on a putting green thereby simulating putting distances whereby the distance disposed between a given receptor and said ramp is shorter than a correlated distance on a putting green and said predetermined ramp angle is calculated to reduce the distance of a given receptor to a correlated distance on a putting green in a repeatable manner thereby simulating actual distances on a putting green with said receptors sequentially spaced from said ramp;

said member comprising a plurality of sections interconnected to define an inclined axis;

said member is supported by support posts having increasing lengths thereby defining an inclined axis, and each support post includes a connector for interconnecting adjacent sections.

* * * * *